US006990211B2

(12) United States Patent
Parker

(10) Patent No.: US 6,990,211 B2
(45) Date of Patent: Jan. 24, 2006

(54) AUDIO SYSTEM AND METHOD

(75) Inventor: Jeffrey C. Parker, Magnolia, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 241 days.

(21) Appl. No.: 10/364,102

(22) Filed: Feb. 11, 2003

(65) Prior Publication Data

US 2004/0156512 A1 Aug. 12, 2004

(51) Int. Cl.
*H04R 5/02* (2006.01)

(52) U.S. Cl. ..... 381/310; 381/18
(58) Field of Classification Search ..... 381/74, 381/309, 310, 311, 17, 18

See application file for complete search history.

(56) References Cited

U.S. PATENT DOCUMENTS 5,687,239 A * 11/1997 Inanaga et al. ..... 381/309
5,870,481 A * 2/1999 Dymond et al. ..... 381/310
6,038,330 A * 3/2000 Meucci, Jr. ..... 381/371
6,400,374 B2 * 6/2002 Lanier ..... 345/630

* cited by examiner

*Primary Examiner*—Ping Lee

(57) ABSTRACT

The disclosed embodiments relates to orienting a sound field in relation to a user and a generated set of images. For instance, a system may include a sound subsystem, a location subsystem, and a speaker subsystem. The speaker subsystem may include a plurality of sensors and a plurality of speakers. The sound subsystem may include a surround sound circuit that may be connected to a signal source and the speaker subsystem. The location subsystem may receive position information reflective of the orientation of a user and provide a signal that may be used by the sound circuit to adjust the audio signal based on the orientation of the user.

25 Claims, 3 Drawing Sheets

AUDIO SYSTEM AND METHOD

BACKGROUND OF THE RELATED ART

This section is intended to introduce the reader to various aspects of art, which may be related to various aspects in accordance with embodiments of the present invention, which are described and/or claimed below. This discussion is believed to be helpful in providing the reader with background information to facilitate a better understanding of the various aspects in accordance with embodiments of the present invention. Accordingly, it should be understood that these statements are to be read in this light, and not as admissions of prior art.

Microprocessor-controlled circuits are used in a wide variety of applications throughout the world. Such applications may include personal computers, control systems, stereo systems, theater systems, gaming systems, telephone networks, and a host of other consumer products. Many of these microprocessor-based systems may include the capability of delivering audio signals to users, including surround sound signals.

Surround sound systems mimic reality by giving the user the impression that sounds are coming from different locations around the listening environment. A surround sound system manipulates an audio signal, which is sent to various speakers, to give the appearance that objects are around the listener. This effect is achieved by receiving an audio signal and modifying the signal before it is transmitted to a speaker or group of speakers. The adjusted sound signals give the listener the sensation that the listener is located in the middle of the activity that is generating the sound. In combining the surround sound system with the images generated on a screen, the user is able to enjoy a more realistic experience.

In a surround sound system, the speakers may be located around a room or other space. Although the listener may hear the sound inside or outside the defined space, maximum enjoyment may be obtained if the listener is located at a specific location in the defined space. If the space is a room, then the listener may be positioned in the center of the room for maximum surround sound effect.

Surround sound systems do have problems, which reduce the potential enjoyment of the listening experience of the user. One such problem with surround sound systems is that the systems are designed to operate optimally with the listener positioned at a specific location. When the listener moves from the optimal location, the listener is no longer subject to the optimum surround sound effect. Indeed, even turning a listener's head may affect optimal sound quality. Furthermore, the speakers for a surround sound system place certain dimensional limitations on the defined space. The dimension limitations relate to the positioning of the surround sound speakers in the defined space. For example, certain locations that may optimize the sound field may not be practical or feasible locations for the user or speakers to be located.

Moreover, the sounds generated from the surround sound system may prevent any possibility of privacy with the sound generated from the speaker. In some instances, the sounds coming from the system may offend others. In these instances, it may be desirable to reduce the distribution of the sound without reducing the volume or effect for the user.

BRIEF DESCRIPTION OF THE DRAWINGS

Advantages of the invention may become apparent upon reading the following detailed description and upon reference to the drawings in which.

DESCRIPTION OF SPECIFIC EMBODIMENTS

Figure 1:
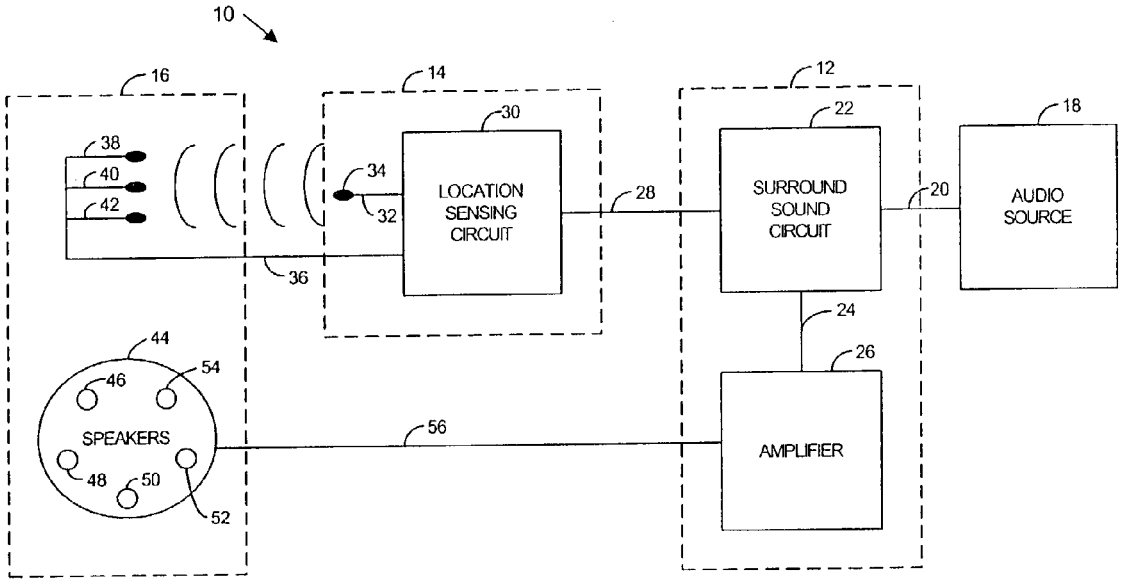
FIG. 1 illustrates a block diagram of components in a system in accordance with an exemplary embodiment of the present invention.

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions are made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The embodiments discussed herein reflect an improved approach that may resolve the issues discussed above, while providing additional functionality to a user. The following disclosed embodiments may provide greater control over a sound field generated from a surround sound system and may enable the user to receive an optimal distribution of sound in a variety of locations. The sound field may be related with the images being viewed by the user, while being oriented with the direction of the user's line of sight. In addition, the disclosed embodiments may reduce the distribution of sound generated from the system, which enables the user to maintain a certain level of privacy in relation to the sound generated from the speakers.

As one possible embodiment, the speaker system may reduce the distortion between a set of displayed images that are related to the generated sound field. As alluded to above, problems may be encountered when the user shifts away from images that are displayed in relation to a fixed sound field. For instance, if the user turns his/her head, the sound field generated may not be oriented relative to the images being generated. In the disclosed embodiments, the sound field generated from the system through the speakers may respond to the user's movements by maintaining the sound field in the proper orientation that is correlative to the position of the displayed images.

For instance, while not limited in any way to such applications, the disclosed embodiments may be used in conjunction with a computer game that utilizes multiple screens and relates to a sound field generated from speakers within headphones. A surround sound system may be designed to produce the optimal audio effect when the user's vision is directed to a central screen. Yet, with the disclosed embodiments, the user may turn from one of another screen to another and have the associated sound field adjust with respect to the user's line of sight. Thus, the disclosed embodiments are able to correlate a sound field with a generated set of images.

To clearly understand the disclosed embodiments, a discussion of the subsystems utilized to correlate the users orientation with the sound being generated is detailed below. As illustrated in the example set forth in FIG. 1, the system may include a sound subsystem 12, a location subsystem 14, and a speaker subsystem 16. The sound subsystem 12 may generate an audio signal that is related to images being displayed, while the location subsystem 14 may determine the user's orientation relative to the images that are displayed. The speaker subsystem 16 may utilize the audio signal to generate a sound field relative to the images that are displayed. By combining these subsystems, a user may experience a sound field that adjusts to the user's movements, while maintaining the proper orientation relative to a displayed image.

As shown in FIG. 1, an audio system 10 may provide a surround sound field to a user that is correlated with a set of images (not shown). As mentioned above, the audio system 10 may include a sound subsystem 12, a location subsystem 14, and a speaker subsystem 16, which may be interconnected to adjust the sound delivered to the user.

The audio system 10 may interconnect these subsystems in a variety of different configurations to produce the oriented sound field for a user. For example, the sound subsystem 12 may be connected to the location subsystem 14 and the speaker subsystem 16. The sound subsystem 12 may generate or receive an audio signal that is related to a set of images. To adjust the audio signal, the location subsystem 14 may exchange information with the speaker subsystem 16 regarding the location or orientation of the user. The location of the user may be a position within a room relative to the images being displayed, while the orientation of the user may be determined by a position of the user's head with respect to the images being displayed. With this location and/or orientation information, the sound subsystem 12 may adjust the audio signals to orient the audio signals to the user's location and/or orientation in a position signal. These modified audio signals may be transmitted to the speaker subsystem 16 to generate the sound field for the user. To clearly understand the various subsystems, each subsystem will be discussed in greater detail below.

The sound subsystem 12 may be utilized to generate audio signals that may relate to images being displayed on a display or screen. For the system 10 to generate a sound field, the sound subsystem 12 may provide audio signals or inputs to the speaker subsystem 16. An audio source 18 may produce the audio signals that may include various signals, such as audio signals, audio streams, or other acoustical signals. The audio source 18 may be a component of a larger system including imaging and graphical displays, such as a VCR, a DVD player, a computer, television, or other similar device.

To generate a sound field, the audio source 18 may communicate signals to a surround sound circuit 22 through a connection 20. The surround sound processor or circuit 22 may decode the signals received from the audio source 18. The surround sound processor or circuit 22 may include a processor, circuitry, and/or logic components to modify or integrate the audio signals with other information received. For example, the surround sound circuit 22 may receive signals from the audio source 18 and may modify the audio signals with other information, such as settings or audio parameters.

The various settings and parameters may be utilized with the audio signal received from the audio source 18 to adjust the sound field produced by the speaker subsystem 16 based on user preference information. For instance, the surround sound circuit 22 may modify the decoded audio signals with audio parameters or initial parameters, such as the volume or audio drive signal strength data parameters, and include initial or sound field parameters relating to the physical orientation of the audio system 10, compensation factors for hearing impairments, optimal positioning information, acoustical effects, or the like. Likewise, the user may adjust sound field parameters or user set-up parameters via a manual input, a remote control, a network connection, or through the console connection. The user set-up parameters may adjust the bass, treble, location of the optimal position, or other audio characteristics, which influence the sound field. These parameters and settings allow the user to modify the sound field or different audio features within the sound field based upon user preference information.

In addition to the parameters and settings, the surround sound circuit 22 may manipulate or adjust the sound pattern based on a position signal generated by the location subsystem 14, as discussed above. The sound subsystem 12 may receive the position signal from the location subsystem 14 via a connection 28. The surround sound circuit 22 may use the position signal to adjust the orientation of the sound field to provide optimize the sound field based on the orientation of a user. The position signal may enable the sound subsystem 12 to modify the audio signal received from the audio source 18 based on the location or orientation of the user.

Once the audio signal is adjusted with the position information, the surround sound circuit 22 may provide a modified signal to an amplifier 26 through a connection 24. The amplifier 26 may receive the modified audio signal and amplify the signal before the signal is transmitted to the speaker subsystem 16 via a connection 56. The amplifier 26 may include user definable parameters, which are similar to the sound field parameters or audio parameters discussed above in relation to the surround sound circuit 22.

To communicate the modified audio signals with the speaker subsystem 16, the connection 56 may be utilized as a path for the exchange of signals. The connection 56 may be a cable, a bundled cable, a fiber optic cable, an infrared link, a wireless communication link, or a link of any other suitable technology. By communicating with the speaker subsystem 16, the modified audio signals transmitted from the amplifier 26 may produce a sound field that is directed according to the user's orientation. Accordingly, the sound field produced by the sound subsystem 12 may account for changes in the location and/or orientation of the user. As fully described below, the location subsystem 14 and the speaker subsystem 16 may include various components that will be interconnected with the sound subsystem 12 in a variety of different configurations.

A second of the subsystems may be the location subsystem 14. As discussed above, the location subsystem 14 may provide the position signal that includes information about the orientation or location of a user to enable the adjustment of the sound field relative to the user. The location subsystem 14 may include location components, such as a processor, transmitters, receivers, sensors, and/or detectors. For example, the location subsystem 14 may be adapted to receive position information from receivers connected to the speaker subsystem 16 and generate a position signal based on that position information, which may include location information (i.e. position of the use in the room) and orientation information (i.e. direction that the use is looking).

To determine the position information, the location subsystem 14 may receive data from various other components that may be utilized to determine the actual orientation and/or location of the user. Components that may be utilized by the location subsystem 14 may be a location sensing circuit 30, a location-sensing sensor 34, and a group of orientation sensors 38, 40, and 42. The location sensing circuit 30 may be a processor or circuitry that manages or analyzes the position information, which relates to the user's orientation and/or location. To gather information related to the user's orientation and/or location, the location sensing circuit 30 may communicate with the location-sensing sensor 34 via a connection 32 and with the group of orientation sensors 38, 40 and 42 via a connection 36.

The location-sensing sensor 34 and group of orientation sensors 38, 40 and 42 may interact to collect the information used by the location sensing circuit 30. The location-sensing sensor 34 and a group of orientation sensors 38, 40 and 42 may be transmitters or receivers depending on a specific design. These components may interact through pulsed infrared signals, RF signals, or similar signals of other suitable technologies. For instance, the location-sensing sensor 34 may be an IR transmitter connected to the location sensing circuit by a connection 32. The orientation sensors 38, 40, and 42 may be IR receivers located adjacent to the user's head or chest region. To exchange information, a signal may be transmitted from the location-sensing sensor 34 to the orientation sensors 38, 40 and 42, which transmit a signal to the location sensing circuit 30. In this configuration, the orientation sensors 38, 40 and 42 may be mounted in a manner to provide the most possible separation, which allows the position information to be more accurately determined.

Once position information, such as the orientation and/or location data, is received by the location sensing circuit 30, the location sensing circuit 30 may process this information to create a position signal that has characteristics based on the orientation or location of the user. This enables the user to move around, while having the sound field adjusted accordingly. To process the orientation and location information, the location sensing circuit 30 may interpret or process the position information with a processor or group of circuits. The processing of the signals may utilize triangulation algorithms or other similar techniques to determine the orientation and/or location of the user. The determination of the position data may depend upon various design factors, such as the number of receivers, the number of transmitters, the number of users being monitored, the location of the transmitters and receivers, and technologies being used to determine the orientation.

Once the user's location and orientation are determined, the location sensing circuit 30 may transmit the position information in a position signal to the sound subsystem 12. More specifically, the surround sound circuit 22 may receive location and orientation information from a location sensing circuit 30 via a connection 28, which may be a physical communication link, a wireless communication link, or communication link of other suitable technology. The communication of this information enables the sound subsystem 12 to modify the audio signal, as discussed above.

As a possible embodiment, the location sensing circuit 30 may be a controller ASIC that generates a pulsed output signal. Additionally, the location-sensing sensor 34 may be an infrared transmitter (IR diode) and the orientation sensors 38, 40 and 42 may be infrared receivers. The infrared signal may be transmitted in the direction of the user or within a defined space, such as from the top of a monitor in the same direction that the monitor displays its image. In this configuration, the orientation sensors 38, 40 and 42 may receive the signals and transmit signals back to a location sensing ASIC. The signals may be transmitted via a cable or wireless link. The location sensing ASIC may interpret the received signals to determine the orientation of the user via triangulation calculations. Based on the phase shifts in the returned pulses from each of the three receivers and the time delays of the received signals versus the original signal transmitted, the location sensing ASIC determines the user's orientation. By comparing the three different phase shifts, the user's orientation may be determined.

In an alternative embodiment, the location-sensing sensor 34 may be an infrared receiver (IR diode) and the orientation sensors 38, 40, and 42 may be infrared transmitters. The infrared signal may be transmitted from the user in the direction of the images being displayed to the user. In this configuration, each of the orientation sensors 38, 40, and 42 may transmit signals to the location-sensing sensor 34, which communicates the signals to a location sensing ASIC. The location sensing ASIC may interpret the received signals to determine the orientation of the user as previously discussed.

The third subsystems may be the speaker subsystem 16. As discussed above, the speaker subsystem 16 may receive the modified audio signals and generate the sound field relative to the orientation or location of the user. The speaker subsystem may include speakers 46, 48, 50, 52 and 54 that are located in a housing 44. Through the speakers 46, 48, 50, 52 and 54, the sound field may be generated based upon signals received from the sound subsystem 12.

To generate a sound field, the speaker subsystem 16 may receive audio signals from the other subsystems, such as the sound subsystem 12 or location subsystem 14, via connection 56. For instance, the audio source, such as a CD, computer, or television, may generate audio signals. The sound subsystem 14 may receive the audio signals and modify the audio signals with the position information in the surround sound circuit 22. Then, the modified signals may be increased in the amplifier 26. The modified audio signals may be transmitted to the speakers 46, 48, 50, 52 and 54 through the connection 56. The speakers 46, 48, 50, 52 and 54 may utilize the modified audio signals to produce the sound field for the user. As discussed above, the modified audio signals may generate a sound field that may be adjusted in a variety of ways based upon the user preference information along with location and orientation information, which may influence the sound generated from each of the different speakers 46, 48, 50, 52 and 54. By utilizing the modified audio signals, the speakers 46, 48, 50, 52 and 54 provide the user with sound that may be tailored to the user's preferences, location, and/or orientation relative to images being generated on a display.

In addition to the modified audio signal, various other factors, such as speaker functionality and configuration, may affect the sound field that is generated by the speakers 46, 48, 50, 52 and 54. With regard to the configuration, the speakers 46, 48, 50, 52 and 54 may be positioned within a housing 44, which may be in a headset and/or around a room. The placement of the speakers 46, 48, 50, 52 and 54 may influence the sounds generated and may require the modified audio signals to be manipulated by the user preferences to provide an optimized sound field. In addition to the speaker configuration, the functionality or capabilities of the speakers 46, 48, 50, 52 and 54 may influence the sound produced as well. For instance, the speakers 46, 48, 50, 52 and 54 may include individual speakers that are specifically designed to enhance certain sounds, such as treble or bass sounds. Thus, the speaker functionality and configuration may influence the sound field generated by the speaker subsystem 16.

Figure 2:
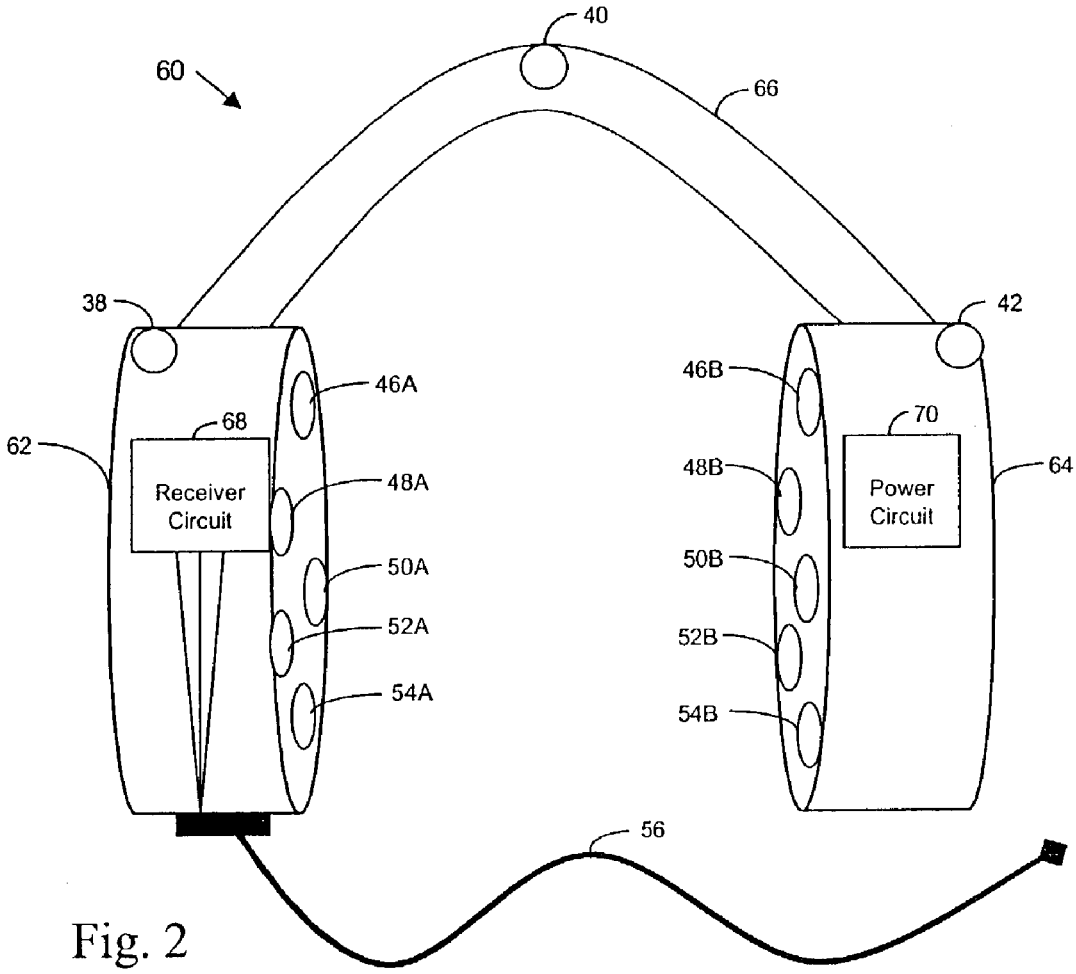
FIG. 2 illustrates a speaker subsystem in accordance with embodiments of the present invention.

Referring generally to FIG. 2, a speaker subsystem in accordance with an exemplary embodiment of the present invention is illustrated. In this embodiment, a headset 60 may house various components of the speaker subsystem 16 shown and discussed above in FIG. 1. The headset 60 may include a first casing 62 connected to a second casing 64 via a connecting strap or other connector 66. The headset 60 may include various components and circuitry, which may be utilized to provide the various functionalities discussed above with regard to FIG. 1. These functions may include generating a sound field and exchanging position information to determine the user's orientation and/or location, for instance To exchange the position information with the location subsystem 14 (see FIG. 1), the headset 60 may include orientation sensors 38, 40, and 42, which assist in the determination of the user's orientation. These orientation sensors 38, 40, and 42 may be disposed at various locations on the headset 60. For instance, the first orientation sensor 38 may be located on the first casing 62 of the headset 60. The second orientation sensor 40 may be located on the connecting strap 66 of the headset 60. The third orientation sensor 42 may be located on the second casing 64 of the headset 60. By arranging these orientation sensors 38, 40, and 42 around the headset 60, each of the orientation sensors 38, 40, and 42 may be positioned to optimize the position information obtained. Alternatively, the orientation sensors 38, 40, and 42 may be separated any from the headset 60. For instance, the orientation sensors 38, 40, and 42 may be attached to a belt around the user or to a badge.

To communicate with the orientation sensors 38, 40, and 42 in the headset 60, the orientation sensors 38, 40, and 42 may interact with the subsystem 14 as previously discussed. In exchanging the position information, the headset 60 may interact with the location subsystem 14 via a receiver circuit 68. The receiver circuit 68 may manage the communication or provide a communication path from the orientation sensors 38, 40, and 42 to other components in providing this function. The position signal may be communicated across a wireless link or a physical link, as discussed above. These links enable the position signal to be exchanged with the other components, such as the location subsystem 14 as described in FIG. 1.

The sound field may be produced for the user through speakers 46A–54B that are attached to the headset 60. The speakers 46A, 48A, 50A, 52A, and 54A may be connect to the first casing 62, while the speakers 46B, 48B, 50B, 52B, and 54B may be attached to the second casing 64. By positioning the speakers 46A–54B in various positions on the headset, an optimal sound field may be produced from a specific configuration. With this configuration, the user may be able to receive the sound field that rotates in a variety of orientations, such as up, down, left, or right, as discussed above.

For the various components to operate within the headset 60, a source of voltage or power may be utilized, such as a power circuit 70. The power circuit 70 may include a battery, an array of batteries, or a connection to a power source. The power circuit 70 may provide power to the orientation sensors 38, 40, and 42, speakers 46A, 48A, 50A, 52A, and 54A, the receiver circuit 68, or other components within the headset 60.

While the sound subsystem 12 may comprise a headset 60, in an alternative embodiment, the speaker subsystem 16 may include speakers located in a room or defined space. In this embodiment, the user may have orientation sensors 38, 40, and 42 attached to the user to provide position information to the location subsystem 14 for creation of a modified audio signal. The sound field may then be modified with the information received from the orientation sensors 38, 40, and 42, as discussed above. Similarly, the speakers 46A–54B may be mounted on the floor, on the ceiling, or at other locations within the defined space. In this configuration, the user may still adjust various parameters, such as the user set-up parameters or audio parameters, to control the distribution of sound.

For instance, if the speakers 46A–54B are mounted on the ceiling, the sound may be "lowered" by adjusting the user set-up parameters of the surround sound processor. Similarly, if the speakers 46A–54B are very close and utilized for a user at a computer display, the sound field can be adjusted to give the impression that the speakers are farther away. These adjustments may be made to enable the user to change default settings or other initial parameters, as discussed above.

Figure 3:
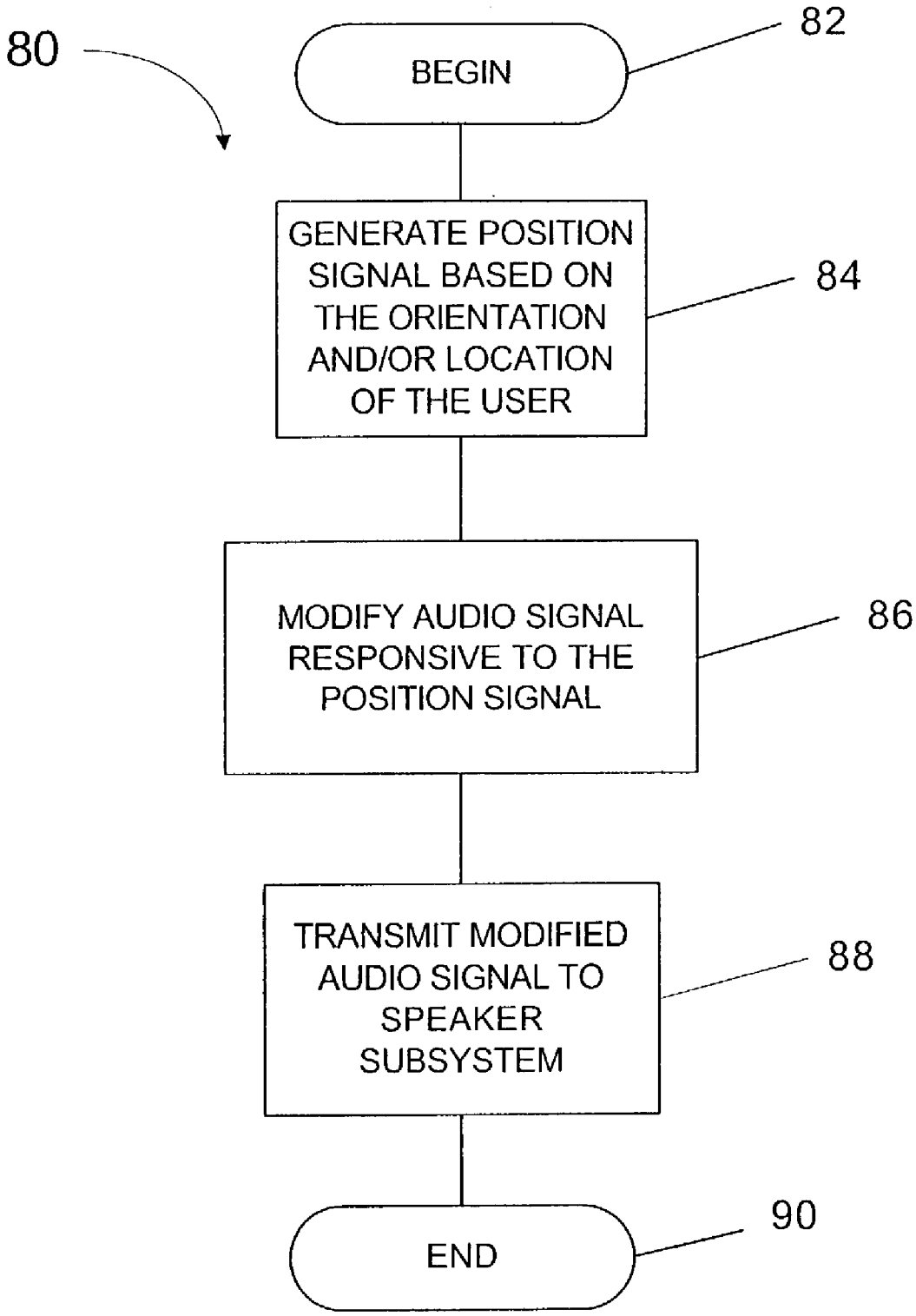
FIG. 3 illustrates a flow diagram in accordance with embodiments of the present invention.

Turning to FIG. 3, a flow diagram is illustrated in accordance with an exemplary embodiment of the present invention. In the diagram, generally referred to by reference numeral 80, the interactions between the various subsystems discussed above are shown. The process begins at block 82. At block 84, a position signal or position information signal may be generated by a source. The position signal may relate to the user's orientation and/or location relative to the images being displayed, as discussed above. For instance, the source of the position signal may be the location subsystem 14, as discussed with regard to FIG. 1 and FIG. 2. Also, the position signal may include other information, such as the room's dimensional information, which may be communicated by a wireless technology or through a physical connection. An input or audio signal may be delivered to the system by from an audio source within the sound subsystem 12, as discussed above in regards to FIG. 1 and FIG. 2. The audio signal may be generated by a stereo, a DVD player, a VCR, a computer, TV, or similar device.

To provide the adjusted sound field, the audio signal may be modified as shown at block 86 based on the position signal, which may include the location and orientation information, created at block 84. As discussed above, the modifications may include various factors, such as user defined setup parameters, user preference data, user preference information, initial parameters, or signal parameters. Likewise, the modification may be implemented in any of the subsystems, as discussed above.

To generate the sound field for the user, the adjusted or modified audio signal may be transmitted to the speaker subsystem, as shown at block 88. Once the signal is transmitted to the speaker subsystem, the adjusted or modified audio signal may be utilized by the speaker to generate a sound field for the user. As discussed above with regard to FIGS. 1 and 2, the speakers receive the signals and produce the sound for the user. The sound field may be adjusted and rotated according to the orientation, location, or position of the user to provide the user with an enhanced listening experience. Accordingly, the process ends at block 90.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An audio system comprising:

a speaker subsystem comprising a headset having a first casing and a second casing attached together via a connecting strap, wherein each of the first casing and the second casing include at least five speakers of a plurality of speakers to adjust a sound field in any plane based on an orientation of a user's head, wherein a first position sensor is disposed on the first casing, a second position sensor is disposed on the connecting strap and a third position sensor is disposed on the second casing to provide information on the orientation of the user's head in any plane and location of the user;

a location subsystem adapted to receive position information from the first, second and third position sensors and to create a position signal, wherein the position information includes information relating to an orientation and a location of a user; and a sound subsystem having a sound processing circuit adapted to modify an audio signal based on the position signal that produces a modified audio signal and to deliver the modified audio signal to the at least one speaker to adjust a sound field produced by the at least one speaker for the user.

2. The audio system set forth in claim 1, wherein the sound subsystem comprises a surround sound subsystem.

3. The audio system set forth in claim 2, wherein the plurality of position sensors are disposed on a user's head.

4. The audio system set forth in claim 2, wherein the surround sound subsystem uses the position signal to adjust the sound field according to the orientation of the user along with a setting utilized to adjust the sound field based on an acoustical effect.

5. The audio system set forth in claim 1, wherein the sound subsystem comprises an initial parameter indicative of user preference information, wherein the user preference information is used with the position signal and audio signal to generate the modified audio signal to adjust the sound field based on a user preference associated with audio drive signal strength.

6. The audio system set forth in claim 1, wherein the location subsystem receives position information via an infrared signal at a location-sensing sensor separated from the user, the plurality of position sensors being coupled to the user.

7. The audio system set forth in claim 1, wherein the location subsystem receives position information from the plurality of position sensors via an RF signal.

8. The audio system set forth in claim 1, wherein the surround sound subsystem uses the position signal to adjust the sound field according to the orientation of the user along with a setting utilized to adjust the sound field based on a user preference for a hearing impairment.

9. A system, comprising:

a speaker subsystem comprising a headset having a first casing and a second casing attached together via a connecting strap, wherein each of the first casing and the second casing include at least five speakers of a plurality of speakers to adjust a sound field in any plane based on an orientation of a user's head, wherein a first position sensor is disposed on the first casing, a second position sensor is disposed on the connecting strap and a third position sensor is disposed on the second casing to provide information on the orientation of the user's head in any plane and location of the user;

a location subsystem adapted to receive position information from the first, second and third position sensors and to create a position signal, wherein the position information is correlated to a plurality of images and includes information relating to an orientation of the user's head relative to the plurality of images and a location of the user; and a sound subsystem having a sound processing circuit adapted to modify an audio signal based on the position signal that produces a modified audio signal and to deliver the modified audio signal to the at least five speakers to adjust a sound field produced for the user.

10. The system set forth in claim 9, wherein the sound subsystem comprises a surround sound subsystem.

11. The system set forth in claim 10, wherein the position signal comprises information relating to the orientation of the user's head relative to the user's line of sight determined from the orientation relative to a computer system providing the plurality of images.

12. The system set forth in claim 10, wherein the surround sound subsystem-uses the position signal to adjust a sound field according to an orientation of the user relative to a display that produces the plurality of images.

13. The system set forth in claim 9, wherein the sound subsystem comprises an initial parameter indicative of user preference information that compensates for an acoustical effect, and wherein the user preference information is used with the position signal and audio signal to generate the modified audio signal.

14. The system set forth in claim 9, wherein the location subsystem receives position information from the plurality of position sensors via an infrared signal.

15. The system set forth in claim 9, wherein the location subsystem receives position information from the position sensors via an RF signal.

16. The system set forth in claim 9, wherein the sound subsystem comprises an initial parameter indicative of user preference information that compensates for a hearing impairment, and wherein the user preference information is used with the position signal and audio signal to generate the modified audio signal.

17. A method of operating an audio system, the method comprising:

generating a position signal from a first, second and third sensors, wherein the position signal includes information relating to an orientation and a location of a user;

modifying an audio signal based the position signal to create a modified audio signal;

transmitting the modified audio signal to a speaker subsystem comprising a headset having a first casing and a second casing attached together via a connecting strap, wherein each of the first casing and the second casing include at least five speakers of a plurality of speakers to adjust a sound field in any plane based on an orientation of a user's head, wherein the first position sensor is disposed on the first casing, the second position sensor is disposed on the connecting strap and the third position sensor is disposed on the second casing to provide information on the orientation of the user's head in any plane and location of the user; and generating a sound field for the user from a plurality of speakers based on the modified signal.

18. The method set forth in claim 17, wherein the act of modifying the audio signal comprises generating surround sound data.

19. The method set forth in claim 17, comprising employing an initial parameter indicative of user preference information that compensates for an acoustical effect to generate the modified audio signal.

20. The method recited in claim 17, comprising transmitting the modified audio signal via a wireless communication link.

21. The method recited in claim 17, wherein the position signal comprises location information of the user and is combined with a user preference setting to adjust the sound field based on a user preference associated with audio drive signal strength.

22. An audio system comprising:

a speaker subsystem comprising a headset having a first casing and a second casing attached together via a connecting strap, wherein each of the first casing and the second casing include at least five speakers of a plurality of speakers to adjust a sound field in any plane based on an orientation of a user's head, wherein a first position sensor is disposed on the first casing, a second position sensor is disposed on the connecting strap and a third position sensor is disposed on the second casing to provide information on the orientation of the user's head in any plane and location of the user;

a location subsystem separated from the user and configured to receive position information from the first, second and third position sensors to create a position signal having information relating to an orientation and a location of the user; and a sound subsystem configured to modify an audio signal based on the position signal to form a modified audio signal, and deliver the modified audio signal to the plurality of speakers to adjust a sound field produced by the plurality of speakers for the user.

23. The audio system set forth in claim 22, wherein the sound subsystem-uses the position signal along with a user preference setting to adjust the sound field based on an acoustical effect.

24. The audio system set forth in claim 22, wherein the sound subsystem-uses the position signal along with a user preference setting to adjust the sound field based on audio drive signal strength.

25. The audio system set forth in claim 22, wherein the location subsystem receives position information from the first position sensor, the second position sensor and the third position sensor via infrared signals.

* * * * *

UNITED STATES PATENT AND TRADEMARK OFFICE

CERTIFICATE OF CORRECTION

PATENT NO. : 6,990,211 B2
APPLICATION NO. : 10/364102
DATED : January 24, 2006
INVENTOR(S) : Jeffrey C. Parker It is certified that error appears in the above-identified patent and that said Letters Patent is hereby corrected as shown below:

In column 10, line 46, in Claim 17, after "third" insert -- position --.

In column 10, line 49, in Claim 17, after "based" insert -- on --.

Signed and Sealed this

Twenty-second Day of September, 2009

David J. Kappos

David J. Kappos
*Director of the United States Patent and Trademark Office*